United States Patent [19]

Massey

[11] Patent Number: 4,967,943

[45] Date of Patent: Nov. 6, 1990

[54] CARRIER DEVICE FOR UMBRELLA

[76] Inventor: Brent F. Massey, 109 Main St., Bondsville, Mass. 01009

[21] Appl. No.: 432,149

[22] Filed: Nov. 6, 1989

Related U.S. Application Data

[63] Continuation-in-part of Ser. No. 282,621, Dec. 12, 1988, abandoned.

[51] Int. Cl.[5] ..... A45B 11/02

[52] U.S. Cl. ..... 224/189; 224/251; 224/265; 224/264

[58] Field of Search ..... 224/189, 186, 187, 188, 224/190, 200, 201, 242, 251, 252, 264, 265, 266, 269, 272, 915; 135/20 R, 90; 248/540

[56] References Cited

U.S. PATENT DOCUMENTS

| | | | |
|---|---|---|---|
| 225,409 | 3/1880 | Mora | 224/190 |
| 839,473 | 12/1906 | Gra | 224/189 |
| 1,205,917 | 11/1916 | Merrill | 224/190 |
| 1,368,516 | 2/1921 | McCourt | 224/189 |
| 2,041,494 | 5/1936 | Schultze | 224/189 |
| 3,554,203 | 1/1971 | Hall | 135/20 R |

FOREIGN PATENT DOCUMENTS

| | | | |
|---|---|---|---|
| 2734663 | 2/1979 | Fed. Rep. of Germany | 224/189 |
| 767014 | 1/1957 | United Kingdom | 224/264 |

*Primary Examiner*—Linda J. Sholl

*Attorney, Agent, or Firm*—Chapin, Neal and Dempsey

[57] ABSTRACT

A carrier device for umbrellas has a shoulder engaging hook and stabilizer affixed in spaced relation on the lower end of the umbrella shaft. The shoulder hook is concave to conform to the shoulder of the wearer and its free end is angled toward the middle of the back for more secure gripping. The stabilizer is disposed below the shoulder hook and is vertically curved to conform to the upper torso of the wearer and has a concavely curved upper edge to accommodate the arm of the user for stabilizing the umbrella. In addition, the stabilizer includes an opening to provide a handle portion whereby the umbrella may be hand held when not fitted onto the torso.

7 Claims, 2 Drawing Sheets

CARRIER DEVICE FOR UMBRELLA

This application is a continuation-in-part of my copending application for "CARRIER DEVICE FOR UMBRELLAS", Ser. No. 07/282,621 filed Dec. 12, 1988 now abandoned.

BACKGROUND OF THE INVENTION

Conventional umbrellas are usually held with one hand and, when so used, have the inherent drawback that only one of the user's hands is free for other tasks. It is for this reason that outdoor workers, such as mailmen and the like do not usually carry umbrellas. To overcome this problem, various devices have been developed by which the umbrella may be fitted onto the body and carried without the use of the hands.

Examples of these carrying devices are shown in U.S. Pat. Nos. 1,657,263 to Lauby; 1,850,497 to Cromby; and 4,537,339 to Pearson. While these patents may have subtle design differences from one to the other, they are all basically harness systems which strap to the upper torso of the user and, in various ways, attach a conventional umbrella to the carrier.

U.S. Pat. Nos. 2,085,984 to Kruithof and 3,700,149 to Grogan show harness systems for carrying umbrellas similar to those described in the previous paragraph. But, in these patents, the umbrellas are especially adapted to fit the particular harness.

The carrier devices of the above patents all share the following problems:

1. Relative difficulty in connecting and disconnecting the umbrella from the harnesses.
2. Relative difficulty in putting on the umbrella harnesses.
3. The harnesses are generally cumbersome and interfere with the use of shoulder carried bags.
4. The harnesses present an unattractive appearance and may often wrinkle or damage the wearer's clothing.

German Offenlegungsschrift 2734663 to Wiedermann shows a number of umbrella mounts. FIG. 6 shows a shoulder hook 14, an intermediate portion 13 and a handle of unitary design. The umbrella handle is of conventional circular cross-section, as is shoulder hook 14, while the cross-section of portion 13, adapted to be disposed between the torso and the arm, is not disclosed. The significant drawback of this arrangement, regardless of whether the shape of the intermediate portion 13 is considered circular or flat, is that it does not provide adequate means for stabilizing the umbrella in upright orientation. If circular in cross-section, part 13 would have only minimum surface available for gripping while, if flatter, the circular handle, also under the arm, would interfere with securing the arm gripping part 13. In addition, the Wiedermann mount cannot be adjusted to fit persons of different size due to its unitary design and the result is an uncomfortable fit for many users.

The present invention relates to an umbrella support, and particularly to improvements therein, which constitute a significant departure from the typical umbrella supports.

The principal object of this invention is to provide an umbrella carrier device which permits freedom of both hands of the user but involves no body harness or straps.

Another object of this invention is to provide an improved umbrella carrier which is universally adaptable to persons of widely different physiques.

A further object of this invention is to provide an umbrella carrier which is easy to use and inexpensive to manufacture.

Yet another object of this invention is to provide an umbrella carrier which is readily adaptable for retrofitting conventional umbrellas and for use on equipment of original manufacture.

Yet another further object of this invention is to provide a dual purpose stablizer/handle member whereby the umbrella may be stabilized when carried by the torso and easily hand carried in the usual manner of a conventional umbrella.

The above and other objects and advantages of this invention will be more readily apparent from the following description read in conjunction with the accompanying drawings, in which.

Figure 1:
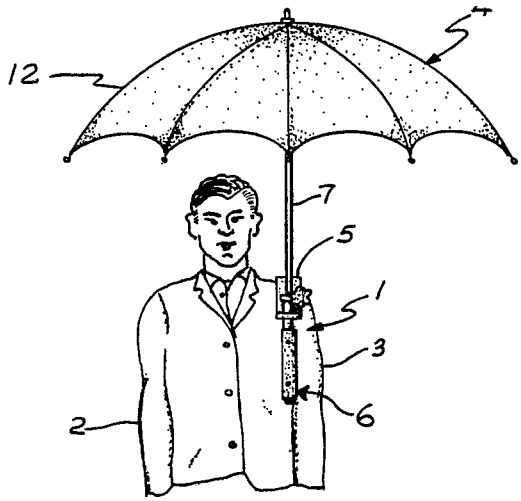
FIG. 1 is a perspective view of an umbrella carrier device of the type embodying this invention, showing the umbrella in an operative position.

Referring now in detail to the drawings, FIG. 1 shows an umbrella carrier of this invention as it would appear in actual use. A person 2 is shown supporting the umbrella on his left shoulder without the use of either hand. The umbrella has a shaft 7 and canopy 12 of conventional construction. A hook portion 5 is fitted over the shoulder and stabilizer 6 is fitted under the upper arm 3. This umbrella carrier is especially suited for persons engaged in outdoor activities requiring the free use of both hands. Examples of such persons include mailmen, metermaids, paperboys, golf caddies, sports spectators and the like.

The umbrella carrier comprises shoulder hook 5 and stabilizer 6 affixed onto the lower end portion of the shaft 7 of umbrella 4. The hook 5 and stabilizer 6 are separately disposed on the shaft 7 in vertically spaced relation and are preferably made of molded synthetic plastic material, such as Nylon or other high impact, tough durable and resilient material which may be fiber reinforced, if necessary.

Figure 2:
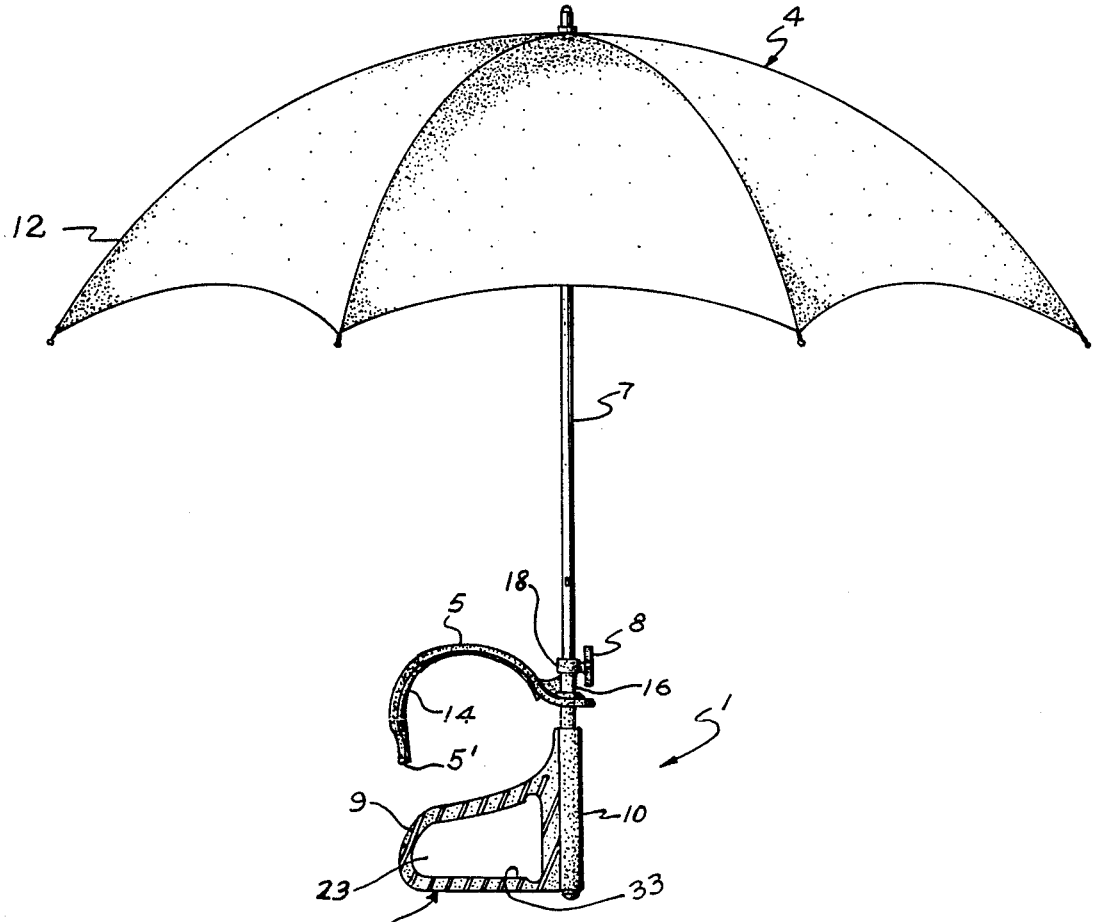
FIG. 2 is a side elevational view of the umbrella and carrier device.
Figure 6:
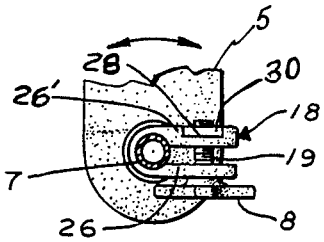
FIG. 6 is a sectional view taken along line 6—6 of FIG. 5.
Figure 5:
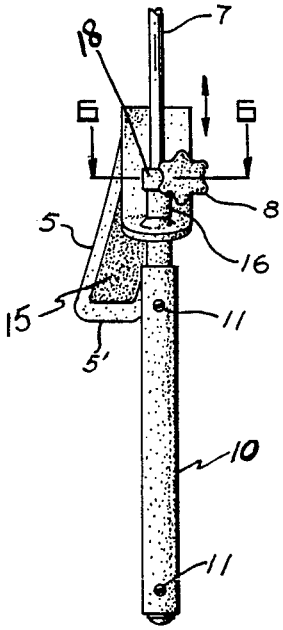
FIG. 5 is a front elevational view of the hook member assembly of the device.

The shoulder engaging hook 5 comprises an inner cylindrical hub portion or sleeve 16 which telescopically fits onto the shaft 7 of the umbrella and may be secured in any desired location by clamping member 18 (FIGS. 2 and 6). Extending, from sleeve 16, the hook comprises a downwardly opening portion curved such that inner surface 14 will conform generally to the shoulder shape of the carrier. As best illustrated in FIG. 5, the hook 5 is also angled inwardly of the vertical plane of the umbrella shaft 7 and centerline of the inner portion of the hook, such that its free end 5' will extend toward the middle portion of the wearer's back. The shoulder hook is preferably formed of a flexible plastic material such that it may conform to different shoulder sizes.

Figure 7:
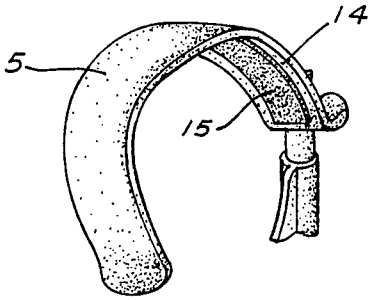
FIG. 7 is a partial perspective view of the shoulder hook and shaft.

As shown in FIG. 7, the concave, lower surface of the hook 5 is preferably provided with a strip 15 of a resilient elastomeric material of high coefficient of friction so as to minimize any tendency of the shoulder hook slipping off the shoulder. The strip 15 constitutes only one means to inhibit such movement and other suitable frictional enhancing means for this purpose will be readily apparent to one skilled in the art.

Sleeve 16 and clamping member 18 are integrally formed to adjustably affix the shoulder hook 5 to the umbrella shaft 7 with the inner diameter of the sleeve portion 16 being selected to fit closely onto the umbrella shaft 7. As seen in FIG. 6, the upper edge portion of sleeve 16 comprises a U-shaped portion 18 that includes an inner semi-cylindrical portion and outwardly extending arm portions 26 and 26' disposed laterally on opposite sides of the shaft 7. Knob 8 is disposed at one end of a threaded bolt 19, the other end of which extends through aligned bores in the two arm portions. Fitted on the outer end of bolt 19 is a nut 30 disposed within recess 28 shaped to accommodate and prevent rotation of the nut so that clockwise rotation of the knob 8 will tighten a clamp 18 on shaft 7. Conversely, counterclockwise rotation of the knob 8 will loosen clamp 18 to enable adjustment of the hook 5 to any suitable position on the shaft, depending upon size and individual preference of the wearer.

Figure 3:
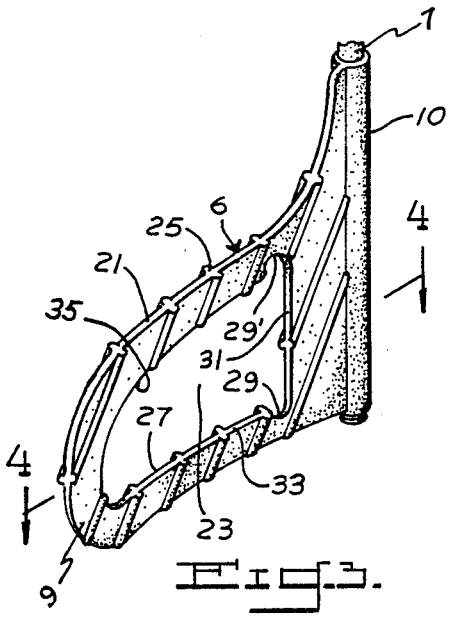
FIG. 3 is a perspective view of the stabilizer portion of the device.
Figure 4:
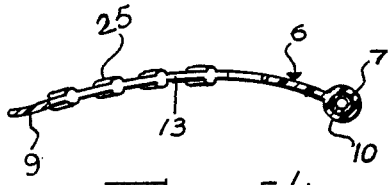
FIG. 4 is a sectional view of the stabilizer taken along section line 4—4 of FIG. 3.

As shown in FIGS. 3, 4 and 5, the stabilizer 6 comprises a cylindrical sleeve portion 10, generally planar blade or panel portion 9 with an opening or aperature 23 therethrough. The sleeve portion 10 of the stabilizer 6 is fitted onto the shaft 7 and secured in place by setscrews 11. The blade or panel portion 9 is preferably curved about a vertical axis, as at 13 in FIG. 4, being concave on the side thereof which will be in contact with the left side of the user when the umbrella is carried on the left shoulder. The concave curvature is selected to correspond ergonomically with the average human torso or body shape to assist in holding the stabilizer in fixed upright position without any palpable discomfort to the user. The upper edge portion 21 of the panel 9 is also concavely curved to fit comfortably under the upper arm of the user. The outer edge of the panel is convexly curved to provide a smoothly flared curve between the lower and upper edge of the panel.

The inner edge 27 of the panel 9 defines opening 23 and generally follows the contour of the outer edge thereof. Rounded corners 29 and 29' of inner edge 27 are located at the junction of the straight, vertical edge 31, straight edge portion 33 and curved edge portion 35 of opening 23 to overcome any tendency for the material to fracture at these otherwise right angled stress points. Ribs 25 are equally spaced and obliquely angled in order to enhance the structural strength or stiffness of the thin panel and to increase its frictional surface contact with the user's clothing. The opening 23 serves to provide a stabilizer panel of large surface area while requiring a minimum amount of plastic molding material for its fabrication. The opening 23 also serves the additional function of providing a convenient handle. In this connection, one's hand may grasp the panel about its tubular portion 10 and parallel edge 31 for holding the umbrella in an upright orientation. Moreover, the other straight edge portion 33 of the opening 23 provides another handle for carrying the umbrella in the manner of a cane or walking stick with the hand clasped about, what is depicted in FIG. 2, as the lower edge portion 33 of the stabilizer panel.

The carrier construction, embodying my invention, is readily adapted for quick and easy disposition and transfer to and from its operative positions. The umbrella may be "opened" and hand carried in the normal manner, and when both hands are needed for any task, the hook can simply be placed over the shoulder and the stabilizer fitted under the arm of the user. The combination of the downwardly opening hook and vertically oriented stabilizer blade provides remarkable vertical and lateral support for the umbrella while freeing both hands for the performance of most manual tasks. In addition, when the umbrella is not fitted on the shoulder, it may be easily carried, such as when walking, in the usual fashions of a conventional umbrella or cane.

Having thus described my invention, what is claimed is:

1. Carrier device for umbrella having a canopy and a shaft comprising a shoulder engaging hook member and a stabilizer extending in axially spaced relation from said shaft and radially thereof, means for affixing said hook member and stabilizer to said shaft, the hook member is disposed above said stabilizer and is adapted to conform to a person's shoulder, the stabilizer is in the form of a planar panel which extends from said shaft in generally the same radial direction as does the hook member and has an opening therethrough defined by a closed perimeter of the panel and is thus adapted to provide a handle for carrying the umbrella when the carrier device is not fitted onto the torso, said panel being characterized overall by a broad surface area in the radial direction and by a thin cross-section perpendicular to said radial direction so that the thin cross-section of said panel is adapted to fit comfortably and securely under an arm of the user when the hook is disposed on the user's shoulder, whereby the umbrella may be carried in "open" position without using either hand or by using said handle formed by the opening through said panel.

2. Carrier device for umbrella having a canopy and shaft, as set forth in claim 1, wherein the hook member and stabilizer are adjustably disposed adjacent the lower end portion of the umbrella shaft so that the spacing therebetween may be varied.

3. Carrier device for umbrella having a canopy and shaft, as set forth in claim 1, wherein said panel is curved to conform with the torso of the user.

4. Carrier device for umbrella having a canopy and shaft, as set forth in claim 1, wherein the panel includes an upper edge portion which is concavely curved to accommodate the arm of the user.

5. Carrier device for umbrella having a canopy and shaft, as set forth in claim 2, wherein the hook member includes a clamping member adapted to adjustably fit onto the umbrella shaft.

6. Carrier device for umbrella having a canopy and a shaft comprising a shoulder engaging hook member and a stabilizer extending in axially spaced relation from said shaft and radially thereof, means for affixing said hook member and stabilizer to said shaft, the hook member is disposed above said stabilizer and is adapted to conform to a person's shoulder, the hook member has an inner end extending radially from said shaft and a free end, said free end being obliquely offset from the inner end of said hook so as to extend toward the middle of the user's back, the stabilizer includes a panel which extends from said shaft in generally the same radial direction as does the hook member and has an opening therethrough adapted to provide a handle for carrying the umbrella when the carrier device is not fitted onto the torso, said panel being characterized by a broad surface area in the radial direction and by a thin cross-section perpendicular to said radial direction so that the panel is adapted to fit comfortably and securely under an arm of the user when the hook is disposed on the user's shoulder, whereby the umbrella may be carried in "open" position without using either hand or by using said handle.

7. Carrier device for umbrella having a canopy and a shaft comprising a shoulder engaging hook member and a stabilizer extending in axially spaced relation from said shaft and radially thereof, means for affixing said hook member and stabilizer to said shaft, the hook member is disposed above said stabilizer and is adapted to conform to a person's shoulder, the stabilizer includes a panel which extends from said shaft in generally the same radial direction as does the hook member and has an opening therethrough adapted to provide a handle for carrying the umbrella when the carrier device is not fitted onto the torso, said panel being characterized by a broad surface area in the radial direction and by a thin cross-section perpendicular to said radial direction so that the panel is adapted to fit comfortably and securely under an arm of the user when the hook is disposed on the user's shoulder, said panel including a plurality of spaced ribs on the surface thereof for enhanced structural strength and slip resistance, whereby the umbrella may be carried in "open" position without using either hand or by using said handle.

* * * * *